US008746184B2

(12) United States Patent
Horne

(10) Patent No.: US 8,746,184 B2
(45) Date of Patent: Jun. 10, 2014

(54) STEAM BOILER WITH RADIANTS

(76) Inventor: William P. Horne, Matthews, NC (US)

( * ) Notice: Subject to any disclaimer, the term of this patent is extended or adjusted under 35 U.S.C. 154(b) by 1132 days.

(21) Appl. No.: 12/695,765

(22) Filed: Jan. 28, 2010

(65) Prior Publication Data

US 2011/0180024 A1 Jul. 28, 2011

(51) Int. Cl.
*F22B 37/10* (2006.01)

(52) U.S. Cl.
USPC ..... 122/247; 122/235.11

(58) Field of Classification Search
USPC ..... 122/31.1, 33, 235.11–365, 367.1, 122/367.3, 155.2, 40
See application file for complete search history.

(56) References Cited

U.S. PATENT DOCUMENTS 1,488,188 A * 3/1924 Anderberg ..... 122/426
1,746,158 A * 2/1930 Loffler ..... 122/249
1,833,504 A * 11/1931 Thomas ..... 122/250 R
2,127,787 A * 8/1938 Schmidt ..... 122/249
2,426,533 A 8/1947 Tompkins
2,658,988 A 11/1953 Clauser et al.
3,051,146 A * 8/1962 Clarkson et al. ..... 122/249
3,477,411 A 11/1969 Gething
3,722,445 A * 3/1973 Karig et al. ..... 114/337
3,727,588 A * 4/1973 Ross ..... 122/487
3,906,188 A 9/1975 Gamell
4,007,712 A * 2/1977 Finger et al. ..... 122/250 R
4,044,727 A * 8/1977 Rychen et al. ..... 122/449
4,351,277 A * 9/1982 Ryan et al. ..... 122/390
4,357,910 A * 11/1982 Blockley et al. ..... 122/248
4,541,245 A * 9/1985 Becker et al. ..... 60/648
4,810,856 A 3/1989 Jovanovic
5,311,843 A * 5/1994 Stuart ..... 122/248
5,546,760 A * 8/1996 Cook et al. ..... 62/497
5,765,509 A * 6/1998 Liebig et al. ..... 122/7 R
5,816,199 A * 10/1998 Khizh et al. ..... 122/367.1
6,668,762 B1 * 12/2003 Khosrowyar ..... 122/18.1
7,243,618 B2 * 7/2007 Gurevich ..... 122/7 R
7,614,367 B1 * 11/2009 Frick ..... 122/26
7,650,933 B2 * 1/2010 Gilbert et al. ..... 165/159
7,922,155 B2 * 4/2011 Havlena ..... 261/62
2004/0013988 A1 1/2004 Kim
2008/0053093 A1 * 3/2008 Kim ..... 60/620
2008/0236516 A1 * 10/2008 Gelbar ..... 122/7 R
2010/0221675 A1 * 9/2010 Rowe et al. ..... 432/29

* cited by examiner

*Primary Examiner* — Steven B McAllister
*Assistant Examiner* — Ko-Wei Lin
(74) *Attorney, Agent, or Firm* — Alston & Bird LLP

(57) ABSTRACT

Apparatuses and methods for producing steam are provided. A steam boiler system may include a steam boiler. The steam boiler may comprise an enclosure with a burner, first and second fluid conveyance members, and one or more radiants therein. The burner produces hot combustion gases which warm the fluid conveyance members and thereby the fluid therein. The radiants are also heated by the combustion gases, and they thereby emit radiation which is absorbed by the fluid conveyance members and/or the fluid therein. The boiler system may additionally comprise a steam separator which separates out a steam component. The steam component can be directed back through the enclosure in a third fluid conveyance member to expand the steam before being fed to a steam engine to produce power.

6 Claims, 3 Drawing Sheets

STEAM BOILER WITH RADIANTS

BACKGROUND OF THE INVENTION

1. Field of the Invention

The present application relates to improving the efficiency of steam boilers by improving the heat transfer to boiler tubes or other fluid conveyance members. The present application further relates to uses such as a steam boiler in combination with a steam engine, and to associated methods.

2. Description of Related Art

Recent changes in the price and availability of fuels have prompted increased interest in technologies outside of internal combustion engines. One such technology is steam power, which has previously been used to power automobiles and other modes of transportation, but which has largely been ignored in modern times. As is well known, steam engines rely on boilers to create the steam necessary to produce motive power. Conventional steam boilers burn a fuel within an enclosure, and the hot combustion gases heat water in order to bring it to a sufficient temperature to produce steam.

However, environmental concerns in addition to the above-mentioned changes in price and availability of fuels have made increased efficiency a necessity. It is in the vital economic and strategic interests of the United States to develop an efficient motive power which is now primarily dependent on imported fuels and develop practical systems which can operate efficiently on fuels which can be produced in large quantities in the United States at reasonable costs. It is a further desirable objective to use motive power which will fit into our existing infrastructure so that a smooth transition can be made to alternative fuels produced within the United States. In this regard, steam engines may be more efficient than internal combustion engines. The boilers to supply steam can be fueled with present petroleum based fuels or with a wide range of alternative fuels which can be competitively produced in large quantities within the United States. Applicant feels that it is incumbent upon him to improve the efficiency of the required boilers at a size and weight suitable for vehicles.

Therefore, Applicant has developed an improved heat transfer device which may be used in a steam boiler and used with a steam engine or for other purposes.

SUMMARY OF VARIOUS EMBODIMENTS

The present disclosure in one aspect describes a boiler comprising an enclosure, a first fluid conveyance member and a second fluid conveyance member, each configured to carry a flow of a fluid to be heated such that the fluid flows through the first fluid conveyance member and then through the second fluid conveyance member, and a burner operable to burn a fuel and produce hot combustion gases within the enclosure. A radiant defining a plurality of apertures therethrough, which may comprise a perforated or expanded metal material, is also disposed in the enclosure. The radiant is arranged between the first and second fluid conveyance members so as to cause the combustion gases to convection-heat the first fluid conveyance member prior to contacting the radiant, the apertures in the radiant then allowing the combustion gases to travel through the radiant to convection-heat the second fluid conveyance member. The radiant is convection-heated by the combustion gases and emits radiation that heats the first and second fluid conveyance members, whereby the fluid conveyance members are heated both by convection from the combustion gases and by radiation from the radiant.

In some embodiments the first and second fluid conveyance members comprise two coils which are concentric about an axis and the radiant is disposed between the two coils of the fluid conveyance member. The burner may be positioned generally along the axis. The boiler may further comprise a target member positioned opposite from the burner within the enclosure.

Embodiments of the invention further include a boiler system, which may comprise the above-described boiler and additionally comprise a fluid supply configured to supply the fluid to an inlet of the first fluid conveyance member and a flash boiler connected to an outlet of the second fluid conveyance member and configured to allow the fluid to separate into a steam component and a liquid component. A third fluid conveyance member may be connected to the flash boiler and to the boiler and configured to direct the steam component back through the boiler in order to further heat the steam component. The third fluid conveyance member may then supply the steam component to a steam engine. In such embodiments an exhaust port in the enclosure may be configured to feed an exhaust gas created by the burner from the enclosure to the steam engine in order to heat the steam engine for increased efficiency.

Additionally, the third fluid conveyance member may be positioned proximate at least one radiant. Further, a control unit may be connected between the outlet of the second fluid conveyance member and the flash boiler, wherein the control unit maintains the fluid within the first and second fluid conveyance members in a liquid state. The control unit may allow the fluid from the fluid conveyance members to enter the flash boiler after the fluid has reached a predetermined pressure or temperature. Also, a recirculation tube may be configured to direct the liquid component back into the fluid supply, and a filter may be configured to filter the liquid component. A pump may be used to feed the fluid from the fluid supply into the inlet of the first fluid conveyance member.

An additional embodiment of the invention includes a method of boiling a fluid. The method comprises flowing a fluid through a fluid conveyance member, burning a fuel to produce hot combustion gases, and first directing the combustion gases past the fluid conveyance member containing the fluid, the combustion gases heating the fluid conveyance member by convection and thereby heating the fluid. Then the combustion gases that first convection-heated the fluid conveyance member are directed through a plurality of apertures in a radiant positioned proximate the fluid conveyance member, the hot combustion gases heating the radiant and the radiant thereby emitting radiation. The method further comprises absorbing the radiation with the fluid conveyance member and/or the fluid to further heat the fluid.

A further embodiment of the invention includes an apparatus configured to facilitate heat transfer from combustion gases to a first fluid conveyance member and a second fluid conveyance member. The apparatus comprises a radiant defining a plurality of apertures therethrough, the radiant being arranged between the first and second conveyance members so as to cause combustion gases to convection-heat the first fluid conveyance member prior to contacting the radiant, the apertures in the radiant then allowing combustion gases to travel through the radiant to convection-heat the second fluid conveyance member. The radiant is convection-heated by the combustion gases and emits radiation that heats the first and second fluid conveyance members, whereby the first and second fluid conveyance members are heated both by convection from the combustion gases and by radiation from the radiant. Additionally, the first and second fluid conveyance members may comprise two coils which are concentric about an axis and the radiant is disposed between the two coils defined by the fluid conveyance members.

BRIEF DESCRIPTION OF THE SEVERAL VIEWS OF THE DRAWING(S)

Having thus described the embodiments in general terms, reference will now be made to the accompanying drawings, which are not necessarily drawn to scale, and wherein:

DETAILED DESCRIPTION OF THE DRAWING(S)

Embodiments of apparatuses configured to facilitate heat transfer, steam boilers, and associated methods now will be described more fully hereinafter with reference to the accompanying drawings, in which some, but not all embodiments are shown. Indeed, the present development may be embodied in many different forms and should not be construed as limited to the embodiments set forth herein; rather, these embodiments are provided so that this disclosure will satisfy applicable legal requirements. Like numbers refer to like elements throughout.

Figure 1:
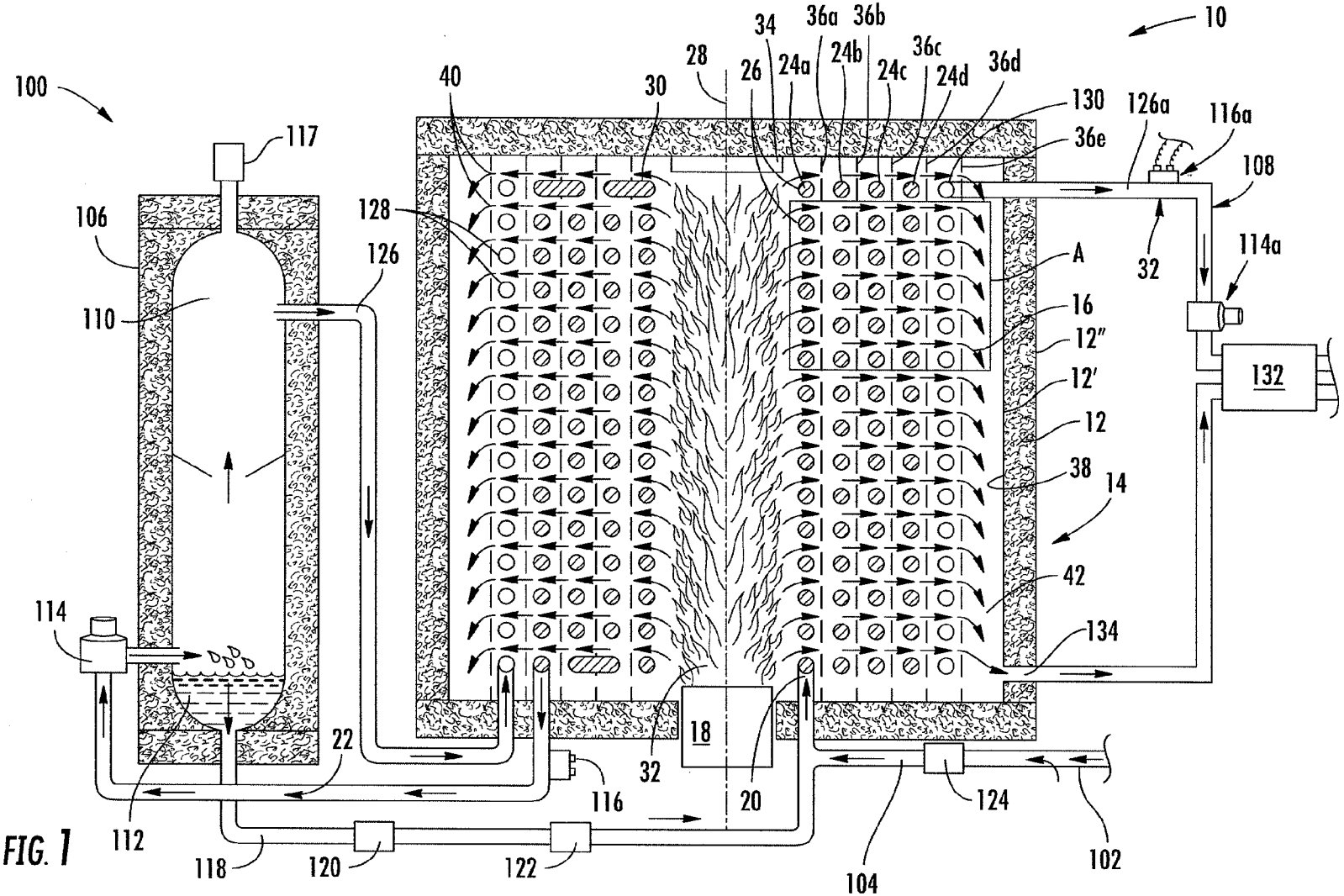
FIG. 1 illustrates a cross-sectional view of an embodiment of a boiler system comprising a boiler.

FIG. 1 illustrates an embodiment of a steam boiler 10 according to the invention. The steam boiler 10 comprises one or more walls 12 forming an enclosure 14. The walls 12 may contain an insulating material between an inner wall 12' and an outer wall 12" so as to retain heat within the enclosure 14. Heat retention may be further encouraged by substantially sealing the enclosure 14 with the exception of allowing hot combustion gases 16 produced by a burner 18 to exhaust out of the enclosure. The burner 18 may be configured to burn a number of different fuels. In this regard, the steam boiler 10 provides significant flexibility as compared to internal combustion engines. For example, the steam boiler 10 may burn solid fuels such as wood, gases such as compressed natural gas, or liquid fuels such as alcohol or petroleum-based fuels. Thus, the steam boiler 10 may take advantage of its external combustion configuration to burn any number of available fuels.

The steam boiler 10 additionally comprises one or more fluid conveyance members 20 within the enclosure 14. The fluid conveyance member 20 is configured to carry a flow of a fluid 22 to be heated. The fluid 22 can comprise water, though various other fluids may be used. In some embodiments a small quantity of oil may be mixed with water in order to resist corrosion within the fluid conveyance member. However, this may not be necessary when the fluid conveyance member 20 is formed from stainless steel or copper. The fluid conveyance member 20 may embody a number of different configurations. In the embodiment illustrated in FIG. 1, the fluid conveyance member 20 comprises a plurality of coils 24*a, b, c, d* which, as will be discussed below, can be considered to comprise separate fluid conveyance members even though they may comprise portions of a single integral unit. In particular, the coils 24*a*, 24*b* of the fluid conveyance member 20 will be described as first and second fluid conveyance members, although any other coils or other shapes, sizes or configurations of fluid conveyance members may comprise the first and second fluid conveyance members. Each of the coils 24 may comprise a plurality of turns 26. In particular, the coils 24 may be concentric about an axis 28, with each coil being displaced from the others by being positioned progressively farther away from the axis. The coils 24 may include connectors 30 such that they form a single fluid conveyance member 20.

As the fluid 22 travels into the fluid conveyance member 20, it first travels through a first coil 24*a* which surrounds the burner 18. In one embodiment, the burner 18 may be generally positioned along the axis 28 so as to evenly heat the fluid conveyance member 20. Thus, as the fluid 22 travels through the fluid conveyance member 20, it is warmed by the heat emitting from the flame 32 produced by the burner 18. In particular, the flame 32 produces hot combustion gases 16 in the enclosure 14, which flow through the enclosure before being exhausted. The hot combustion gases 16 thereby heat the fluid conveyance member 20 by convection, which in turn heats the fluid 22 in the fluid conveyance member by conduction. The enclosure 14 may additionally contain a target 34 which may comprise a refractory material in order to protect the enclosure from direct exposure to the flame 32 emitting from the burner 18. Accordingly, the target 34 may be positioned opposite from the burner 18 on the axis 28.

Additional features are provided in order to encourage efficient production of steam. In particular, the steam boiler 10 comprises one or more radiants 36*a, b, c, d, e* which are disposed in the enclosure 14. The purpose of the radiants 36 is to be heated such that they emit radiation which can be used to further heat the fluid 22 in the fluid conveyance member 20. This can occur directly, such as when the radiants 36 emit radiation which may heat water molecules directly, or the radiation can additionally or alternatively be absorbed by the fluid conveyance member 20, which then heats the fluid 22 through conduction. Therefore, the fluid conveyance member 20 may be heated both by convection from combustion gases 16 and by radiation from the radiants 36.

The radiants 36 comprise a plurality of apertures 40 therethrough. For example, the radiants 36 may comprise a perforated metal material. In one embodiment, the perforated metal material may comprise a steel sheet with a plurality of ¼" diameter holes therethrough, though various other diameters of holes may be used. In another embodiment, the radiants 36 may comprise an expanded metal material, such as expanded steel. In either embodiment or other similar embodiments, the combustion gases 16 convection-heat a first fluid conveyance member 20 prior to contacting the radiant 36*a*. The apertures 40 in the radiant 36*a* then allow the combustion gases 16 to travel through the radiant to convection-heat a second fluid conveyance member 20. For example, in the embodiment illustrated in FIG. 1, the combustion gases 16 heat a first coil 24*a* (which may be described as a first fluid conveyance member 20) prior to contacting a first radiant 36*a*. Thereafter, the apertures 40 in the first radiant 36*a* allow the combustion gases 16 to travel through the first radiant in order to convection-heat a second coil 24*b* (which may be described as a second fluid conveyance member 20). By forcing the combustion gases 16 past a first fluid conveyance member 20 prior to contacting the radiant 36, the radiant may be at least partially shielded from direct exposure to the flame 32, which may otherwise potentially damage the radiant.

As stated above, the apertures 40 may allow combustion gases 16 to travel through the radiants 36 to convection heat any coils 24 on opposite sides of the radiants. In the embodiment illustrated in FIG. 1, the radiants 36 are disposed between the coils 24 of the fluid conveyance member 20. In particular, the radiants 36 are positioned within the enclosure 14 such that they are also concentric with the axis 28 along which the burner 18 is generally positioned. Thus, in this embodiment the combustion gases 16 are forced to travel past the turns 26 of a coil 24 of the fluid conveyance member 20 then through the apertures 40 in a radiant 36 in a repeating pattern before finally reaching an outer circumferential channel 42 from which the combustion gases exhaust. Accordingly, efficient heat transfer to the fluid conveyance member 20 and the fluid 22 is encouraged. Efficient heat transfer is further encouraged by locating the radiants proximate the turns 26 of the fluid conveyance member 20. This close proximity may encourage absorption of the radiation by the fluid conveyance member 20 and/or the fluid 22.

An additional feature intended to encourage efficient heat transfer is that the radiants 36 may be selected such that they have high emissivity and may further emit radiation having wavelengths which correspond to radiation absorption characteristics of the fluid conveyance member 20 or the fluid 22. Conversely, the fluid conveyance member 20 and/or fluid 22 may be selected to efficiently absorb the radiation emitted by the radiants 36. In one embodiment, the fluid conveyance member 20 may comprise a coating configured to absorb the wavelengths of radiation emitted by the radiants 36. Additionally, at least the inner surface 38 of the inner wall 12' may be formed of a material having good reflectivity to infrared. This feature allows the wall 12 to at least partially reflect radiation which hits it such that the radiation may be more likely to be absorbed by the fluid conveyance member 20 than by the wall, which encourages greater thermal efficiency. Additionally the outer wall 12" may have low emissivity to keep heat loss from radiation low.

Although the radiants 36 have been described as comprising a portion of a boiler, this is not necessarily the case. In particular, one or more fluid conveyance members 20 and the radiants 36 may comprise an apparatus (generally indicated in the rectangular section entitled "A" in FIG. 1) configured to facilitate heat transfer from combustion gases 16 to the one or more fluid conveyance members. In this regard, it is noted that any number of embodiments of boilers or many other types of devices could employ the radiants 36 and one or more fluid conveyance members 20 as described above. However, these embodiments are provided merely for exemplary purposes, and are not intended to limit the scope of the applications of the heat transfer apparatus.

To describe the apparatus A more fully, it must be understood that heat transfer from combustion gases in a single pass around boiler tubes or other fluid conveyances by convection may not be particularly efficient, and the combustion gases may act as poor emitters of heat. Accordingly, embodiments use the radiants 36 through which the combustion gases 16 flow and are heated by the combustion gasses passing through them. The radiants 16 may be positioned in the exit zone of the combustion gases 16 as there may otherwise be very little radiant heat from the combustion gases in this zone, but there may be heat energy in the combustion gases which may be extracted by the radiants 36 and radiated to the fluid conveyance member 20. The exit zone herein refers to locations near the last portions of the fluid conveyance member 20 in terms of the flow path of the combustion gases 16. For example, radiants 36*d* and 36*e* are positioned such that they are in the exit zone of the apparatus A because this is proximate the exit of the combustion gases 16 from the apparatus past the last two coils 24*d*, 130. Accordingly, positioning radiants such that they are proximate the last portions of the fluid conveyance member in terms of the flow path of combustion gases may lead to increased efficiency.

The radiants may have high surface emissivity so they may efficiently radiate heat to the fluid conveyance member 20. Further, the fluid conveyance member 20 may have surfaces with high surface absorbtivity, which may increase the efficiency of the steam boiler 10 so that it may be made smaller and/or more efficient than larger steam boilers having conventional construction. A black oxide surface on the radiants 36 and the fluid conveyance member 20 may accomplish the above as it may have both high emissivity and high absorbtivity.

Returning to an application of the heat transfer facilitating apparatus, the above-described steam boiler 10 may be included as part of a boiler system 100. The boiler system 100 may further include a fluid supply tube 102 configured to supply the fluid 22 to an inlet 104 of the fluid conveyance member 20, and in particular at least indirectly to the first fluid conveyance member as described above. A steam separator 106 may be connected to an outlet 108 of the fluid conveyance member 20, in particular at least indirectly to the second fluid conveyance member as described above, and configured to allow the fluid 22 to separate into a steam component 110 and a liquid component 112 after it exits the enclosure 14. The steam separator 106 may comprise an insulating material similar to that used in the steam boiler enclosure 14 to discourage heat loss. A differential pressure valve 114 may be connected between the outlet 108 of the fluid conveyance member 20 and the steam separator 106. The differential pressure valve 114 may be used such that it will impose a minimum back pressure on the fluid entering the steam separator 106 to discourage boiling in the coils 24 of the fluid conveyance member 20 on starting and to provide the pressure differential needed for the subsequent operation of the steam separator. To ensure that the temperature in the fluid conveyance member 20 reaches the desired temperature, a thermostat burner control 116 may be used to control the temperature of the fluid 22 exiting through the outlet 108 of the fluid conveyance member. The thermostat burner control 116 may control various aspects of the burner 18 including whether or not the burner is operating and the intensity of the flame 32 it produces in order to control the temperature of the fluid 22 leaving the enclosure 14, although it typically will just control whether the flame is on or off. Further, the steam separator 106 may comprise a pressure release valve 117 which may release pressure from the steam separator before pressure in the steam separator reaches an unsafe level.

Depending on the pressure and temperature reached by the fluid 22 in the fluid conveyance member 20, the fluid may or may not boil in the fluid conveyance member. However, as stated above, the steam separator 106 may allow the fluid 22 to separate into a steam component 110 and a liquid component 112. This occurs as some of the fluid 22 expands from liquid in the steam separator 106. The liquid component 112 may be collected in a recirculation tube 118 configured to direct the liquid component 112 back into the fluid supply 102. This may be beneficial because it recycles the liquid component 112 for reuse, and further, the liquid component may still contain a considerable amount of heat, which can be reclaimed. For example, in some embodiments the liquid component 112 may have a temperature in the order of four hundred degrees Fahrenheit. In order to recycle the liquid component 112 back into the fluid supply 102, the recirculation tube 118 may comprise a filter 122 configured to filter the liquid component. The filter 122 may be used to remove any boiler scale or other solids present in the liquid component 112. The liquid component 112 may also be chemically treated if desired. The recirculation tube 118 may additionally comprise a recirculation pump 120 which may be used to pump the liquid component 112 back into the fluid supply 102. A recirculation pump 124 may then pump the fluid 22 through the fluid conveyance member 20 again.

With further regard to the steam separator 106, the other portion of the fluid 22 entering the steam separator flashes into a steam component 110. The steam separator may convert some of the fluid into the steam component 110 and leave some of the fluid into the liquid component 112. While a steam component 110 has been produced by the steam separator 106, it may be desirable to further heat the steam component before using it to power a steam engine. This is because the steam separator 106 may not operate with perfect efficiency and thereby there may be droplets of the liquid component 112 remaining in the steam component 110, such that the steam component is a "wet steam." Use of a wet steam can be undesirable for at least two reasons. The first such reason is that wet steam produces less power in steam engines than does "dry steam" which occupies a greater volume to power the engine. Thus, wet steam is undesirable from a thermal efficiency perspective. Further, when wet steam is used in a piston-based steam engine, droplets of the liquid component 112 may accumulate in the cylinders of the steam engine, which can lead to hydraulic lock or otherwise damage the steam engine.

Accordingly, the boiler system 100 may further comprise a third fluid conveyance member connected to the steam separator 106 and to the steam boiler 10 which is configured to direct the steam component 110 back through the steam boiler in order to further heat the steam component, and thereby reduce any droplets of the liquid component 112 in the steam component. The third fluid conveyance member 126 may travel through the enclosure 14 such that it is positioned proximate at least one radiant 36. In the illustrated embodiment, the third fluid conveyance member 126 may comprise a plurality of turns 128 forming a coil 130 which is concentric with the axis 28 upon which the burner 18 is generally positioned, although many different configurations are possible as described above with respect to the first and second fluid conveyance members. In particular the third fluid conveyance member 126 is outwardly displaced from the fourth coil 24*d* of the fluid conveyance member 20, with a fourth radiant 36*d* lying between the second fluid conveyance member and the fourth coil and a fifth radiant 36*e* displaced radially outwardly from the second fluid conveyance member. The radiants 36 may heat the third fluid conveyance member 126 and/or the steam component 110 in the third fluid conveyance member in a manner similar to that described above with respect to the fluid 22 in the fluid conveyance member 20, including the first fluid conveyance member and the second fluid conveyance member. Accordingly, the third fluid conveyance member 126 may also be configured to absorb the radiation emitting from the radiants 36. Thus, the third fluid conveyance member 126 may additionally benefit from increased thermal efficiency as described above with respect to the fluid conveyance member 20.

The third fluid conveyance member 126 may include a second thermostat burner control 116*a* positioned on an outlet section 126*a* of the third fluid conveyance member. The thermostat burner control 116 may be set at a higher temperature than the second thermostat burner control 116*a* to furnish a higher pressure on the inlet side of the pressure valve 114. Accordingly, some of the fluid 22 can flash to steam on the discharge side of pressure valve 114 at a lower pressure determined by the lower temperature setting of 116*a*. Both of the thermostat burner control 116 and the second thermostat burner control 116*a* may shut off the burner 18. The outlet section 126*a* of the third fluid conveyance member 126*a* may also include a second pressure valve 114*a* which may function substantially similarly to the pressure valve 114.

The third fluid conveyance member 126 may supply the steam component 110 to a steam engine 132 when the boiler system 100 is used in combination with the steam engine, but many other applications and uses are possible. By using the above-described boiler system 100, heat created by the burner 18 may be efficiently transferred to the fluid 22 so as to produce a steam component 110 while the combustion gases 16 exit the enclosure 14 through an exhaust port 134. By positioning the exhaust port 134 at the bottom of the enclosure 14, this encourages cooler combustion gases 16 which have released more energy to exit the enclosure. However, efficient operation may be further promoted by directing the combustion gases 16 exiting the exhaust port 134 through or around the steam engine 132. By directing the combustion gases 16 created by the burner 18 in this manner, the exhaust from the burner may be used to heat the steam engine 132, which may lead to increased thermal efficiency of the steam engine.

Figure 2:
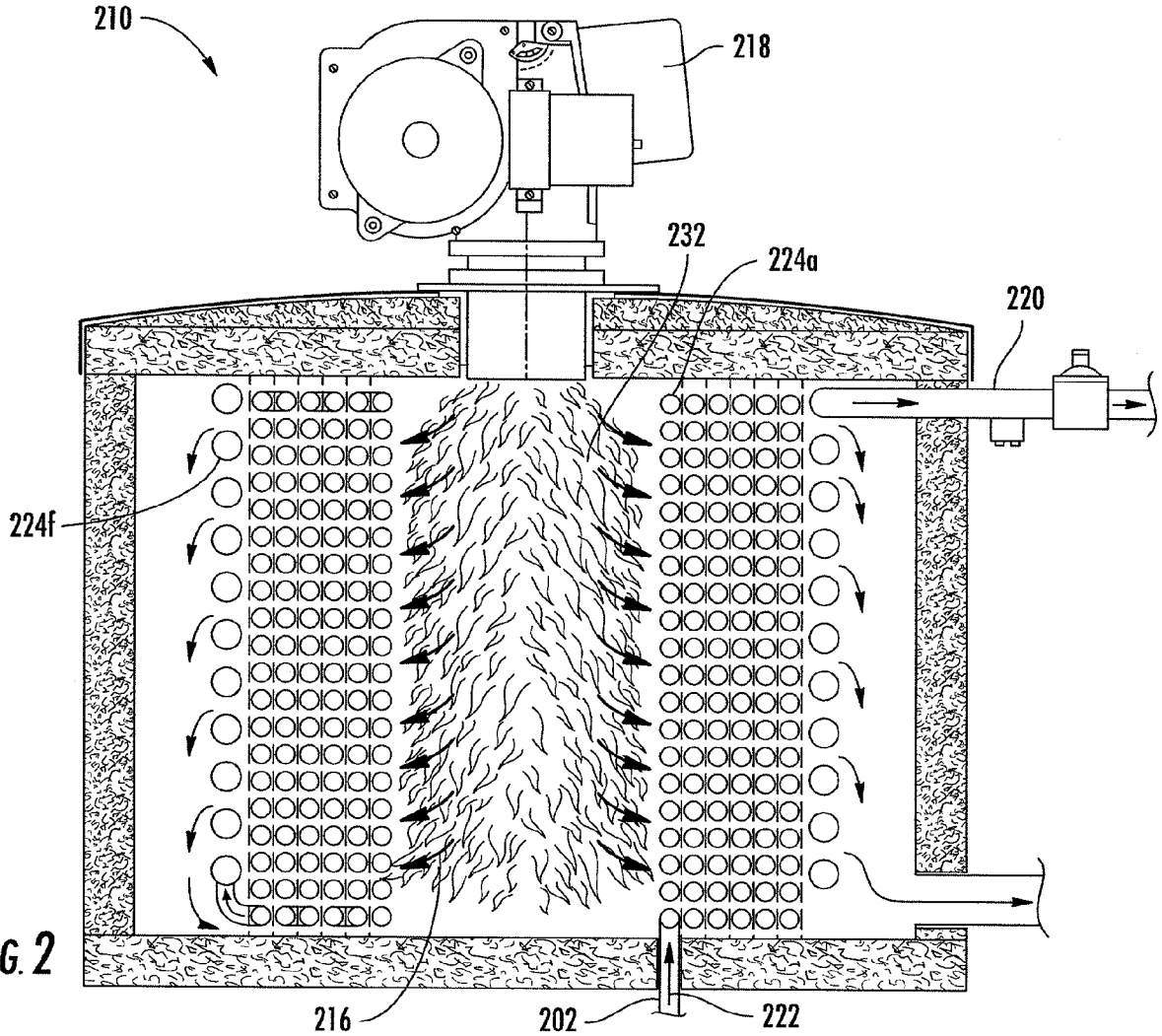
FIG. 2 illustrates a cross-sectional view of an alternate embodiment of a boiler.

An additional embodiment of a boiler 210 is illustrated in FIG. 2. This embodiment of a boiler 210 is similar to the boiler 10 illustrated in FIG. 1, except for a few key differences. A first such difference is that the burner 218 is positioned at the top of the boiler 210, as opposed to the bottom. By directing the flame 232 in a downward direction, a different flow pattern for the hot combustion gases 216 may be established.

The embodiment of a boiler illustrated in FIG. 2 may not require use of a steam separator. In this embodiment the innermost coil 224*a* may be connected to fluid supply 202. In this configuration, a larger outermost coil 224*f* may be used which is larger than the remainder of the coils, and thus is configured to accommodate the expanded steam which results from the fluid expansion. As discussed above, the heat transfer facilitating apparatus may also be used in many other embodiments of boilers and boiler systems.

Figure 3:
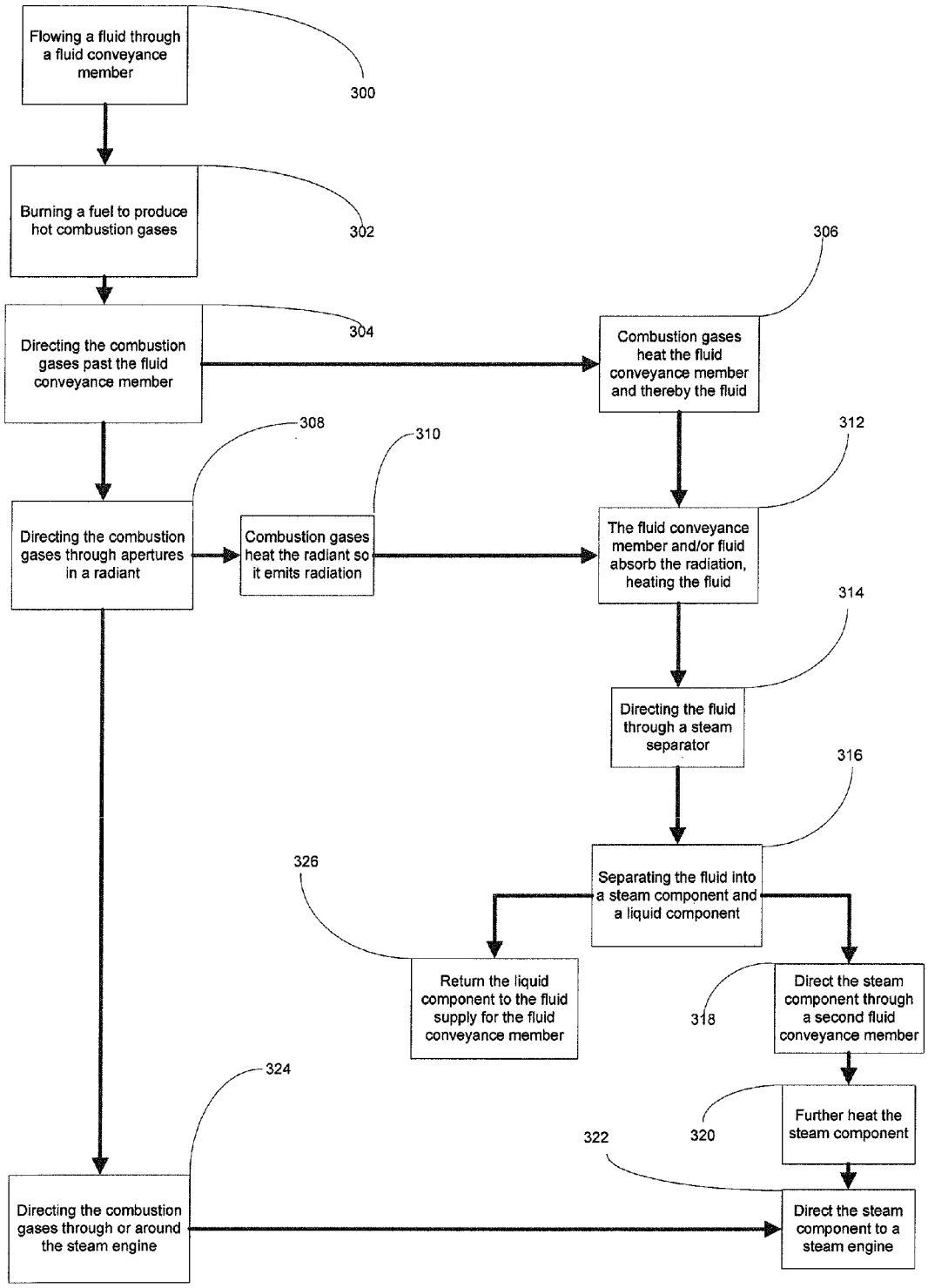
FIG. 3 illustrates an embodiment of a method of boiling a fluid and superheating the fluid.

Embodiments of the invention further comprise methods of boiling a fluid. As illustrated in FIG. 3, one embodiment of the method comprises a step 300 of flowing a fluid through a fluid conveyance member. In an additional step 302 a fuel is burned in order to produce hot combustion gases. In step 304 the combustion gases are directed past the fluid conveyance member, with the combustion gases heating the fluid conveyance member by convection and thereby heating the fluid as shown at 306. In another step 308 the combustion gases may be directed through a plurality of apertures in one or more radiants positioned proximate the fluid conveyance member. The combustion gases heat the radiants, and the radiants thereby emit infrared radiation as shown at 310. The fluid conveyance member and/or the fluid therein may absorb the radiation to further heat the fluid in an additional step 312.

The method may also comprise a step 314 of directing the fluid through a steam separator in order to complete a step 316 of separating the fluid into a steam component and a liquid component. The steam component can thereafter be directed through a second fluid conveyance member at step 318 so as to further heat the steam component as shown at 320. Thereafter a step 322 of directing the steam component to a steam engine may be completed. The method may additionally comprise a step 324 of directing the combustion gases through or around the steam engine so as to heat it for increased efficiency. Additionally, the liquid component of the fluid may be returned to a fluid supply, which supplies fluid to the fluid conveyance member, as shown at 326.

Many modifications and other embodiments will come to mind to one skilled in the art to which these embodiments pertain having the benefit of the teachings presented in the foregoing descriptions and the associated drawings. Therefore, it is to be understood that modifications and other embodiments are intended to be included within the scope of the appended claims. Although specific terms are employed herein, they are used in a generic and descriptive sense only and not for purposes of limitation.

That which is claimed:

1. A boiler system in combination with a steam engine, comprising:

a boiler, comprising:

an enclosure;

a first fluid conveyance member and a second fluid conveyance member, each configured to carry a flow of a fluid to be heated such that the fluid flows through the first fluid conveyance member and then through the second fluid conveyance member;

a burner operable to burn a fuel and produce hot combustion gases within the enclosure; and a radiant disposed in the enclosure and defining a plurality of apertures therethrough, the radiant being arranged between the first and second fluid conveyance members so as to cause the combustion gases to convection-heat the first fluid conveyance member prior to contacting the radiant, the apertures in the radiant then allowing the combustion gases to travel through the radiant to convection-heat the second fluid conveyance member, the radiant being convection-heated by the combustion gases and emitting radiation that heats the first and second fluid conveyance members, whereby the first and second fluid conveyance members are heated both by convection from the combustion gases and by radiation from the radiant;

a fluid supply configured to supply the fluid to an inlet of the first fluid conveyance member;

a flash boiler connected to an outlet of the second fluid conveyance member and configured to allow the fluid to separate into a steam component and a liquid component; and a third fluid conveyance member connected to the flash boiler and to the boiler and configured to direct the steam component back through the boiler in order to further heat the steam component, wherein the third fluid conveyance member is positioned proximate at least one said radiant, wherein the third fluid conveyance member supplies the steam component to the steam engine.

2. The boiler system and steam engine combination of claim 1, further comprising an exhaust port in the enclosure configured to feed an exhaust gas created by the burner from the enclosure to the steam engine in order to heat the steam engine for greater efficiency.

3. The boiler system of claim 1, further comprising a control unit connected between the outlet of the second fluid conveyance member and the flash boiler, wherein the control unit maintains the fluid within the first and second fluid conveyance members in a liquid state.

4. The boiler system of claim 1, further comprising a recirculation tube configured to direct the liquid component back into the fluid supply.

5. The boiler system of claim 1, wherein the radiant comprises a perforated metal material.

6. The boiler system of claim 1, wherein the radiant comprises an expanded metal material.

* * * * *